United States Patent [19]

Kuhl

[11] Patent Number: 4,864,299

[45] Date of Patent: Sep. 5, 1989

[54] GUIDE BEACON

[76] Inventor: Hans J. Kuhl, Osemundstrasse 13, 5982 Neuenrade, Fed. Rep. of Germany

[21] Appl. No.: 123,935

[22] PCT Filed: Feb. 7, 1987

[86] PCT No.: PCT/EP87/00059

§ 371 Date: Sep. 29, 1987

§ 102(e) Date: Sep. 29, 1987

[87] PCT Pub. No.: WO87/04741

PCT Pub. Date: Aug. 13, 1987

[30] Foreign Application Priority Data

Feb. 10, 1986 [DE] Fed. Rep. of Germany ... 8603514[U]

[51] Int. Cl.[4] ..... E01F 9/04; G02B 5/12

[52] U.S. Cl. ..... 340/908.1; 116/63 P; 116/202; 350/97

[58] Field of Search ..... 116/202, 63 R; 362/262; 340/74, 114 R

[56] References Cited

U.S. PATENT DOCUMENTS

| | | | |
|---|---|---|---|
| 4,245,922 | 1/1981 | Auriemma | 404/10 X |
| 4,398,239 | 8/1983 | de Vos et al. | 362/263 |
| 4,475,101 | 10/1984 | Kulp et al. | 116/63 R X |
| 4,674,431 | 6/1987 | Cory | 340/114 R |

FOREIGN PATENT DOCUMENTS

| | | | |
|---|---|---|---|
| 0000370 | 1/1979 | European Pat. Off. . | |
| 2939111 | 5/1980 | Fed. Rep. of Germany . | |
| 2943257 | 11/1980 | Fed. Rep. of Germany . | |
| 3033660 | 4/1982 | Fed. Rep. of Germany . | |
| 8509372 | 5/1985 | Fed. Rep. of Germany . | |
| 1325086 | 8/1973 | United Kingdom | 362/262 |

*Primary Examiner*—Daniel M. Yasich

*Attorney, Agent, or Firm*—Edwin D. Schindler

[57] ABSTRACT

The vertically-arranged beacon plate or the sign support of the transportable traffic beacon is designed to be resistant to breakage and restorable to its original shape after distortion. The essentially flat and elongate beacon plate, which is clipped by its narrow side into a corresponding recess in a base plate in which it is secured by locking means, is made of a high impact-resistant thermoplastic or an elastomer-modified thermoplastic, and has vertical edge profiles. These are preferably hollow profiles for receiving reinforcement elements with, if necessary, weak points, the elements being easily replaceable after damage; for this purpose they can be elastically clipped in the hollow edge profiles with longitudinal slots. Additional reinforcement elements made of a tough, deformable material, e.g., metal, can be located successively in a longitudinal direction in the actual body of the beacon plate to prevent the springing-back of the beacon after bending or buckling and these can be bent back to assume their initial shape together with the beacon plate.

10 Claims, 2 Drawing Sheets

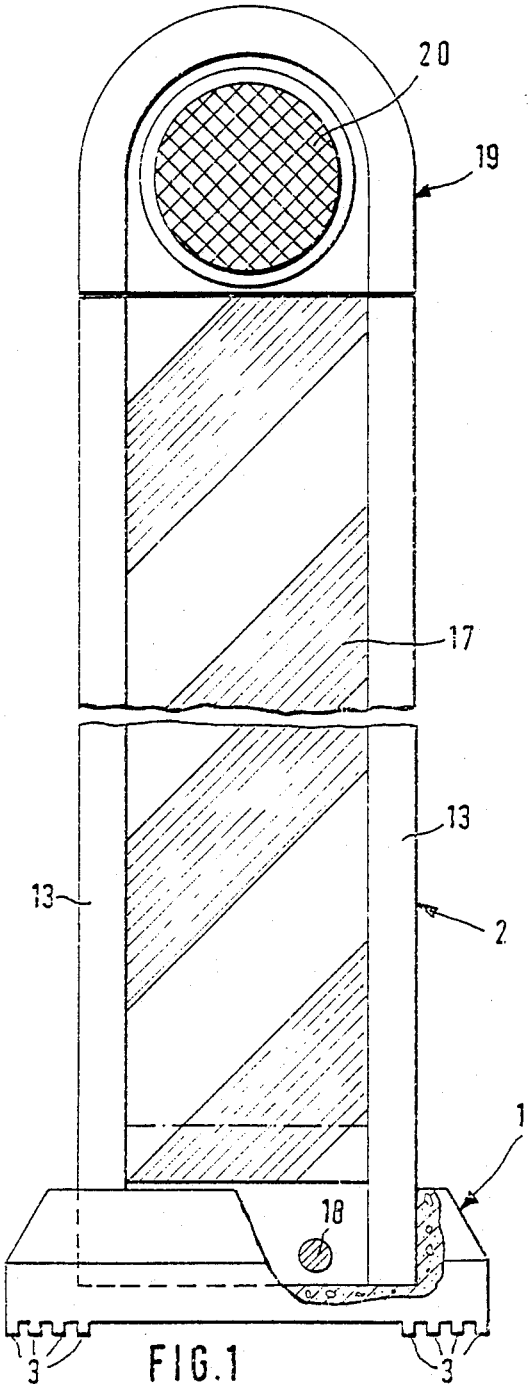
FIG.1
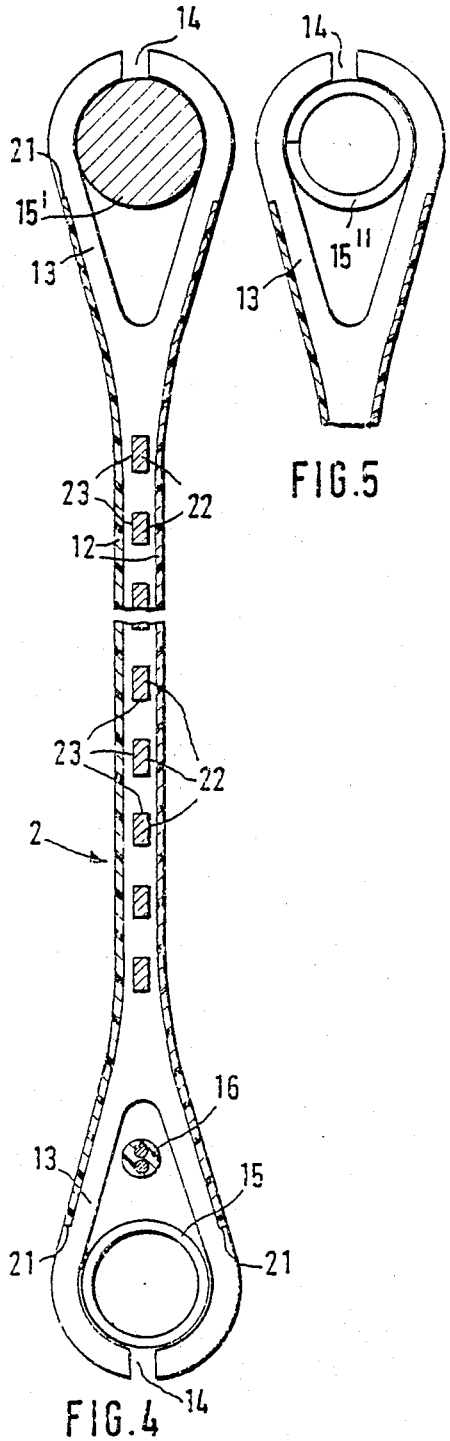
FIG.5
FIG.4

GUIDE BEACON

TECHNICAL FIELD OF THE INVENTION

The invention relates to a guide beacon in order to safeguard working places. More particularly, the present invention relates to a guide beacon having a base plate and with a beacon plate vertically arranged and secured in a recess of the base plate.

PRIOR ART

A guide beacon of this type serves for the safeguarding, traffic guidance and blocking of working places, particularly road construction sites, and for the marking of roadways and the blocking in the working area. The base plate must have high steadiness and stability. On the one hand, the beacon plate must be connected to the base plate sufficiently firmly and, on the other hand, should be sufficiently elastic, in order to be able to deflect if it is hit by a vehicle. The beacon plate shall not break. In addition, it is necessary that the beacon plate can be used again after deformation caused by an accident. These requirements are hardly consistent with one another.

SUMMARY OF THE INVENTION

The object of the invention is to provide a guide beacon that, on the one hand, is stable and break-proof and thus does not present a hazard for the safety on the road, and that, on the other hand, the beacon plate is restorable to its original shape after distortion and thus is reusable.

According to the invention this object is achieved in that the beacon plate is made of a high impact-resistant thermoplastic resin or an elastomer-modified thermoplastic resin and has vertical edge profiles. Since the beacon plate is to be restorable to its original shape following a distortion thereof, such as after an accident, the high-impact resistant or elastomer-modified resins useful in connection with the present invention dictate that such resins be copolymers having gum-like, or resilient, properties.

The invention differs from the prior art in that the beacon plate is clipped on one side into the base plate and due to its high impact-resistant property is adapted to deflect without breaking, in case of an impact. It is possible to restore the beacon plate to its original shape without destruction and thus it is reusable after a damage. The beacon plate is break-proof and is not a risk for the safety on the road. The beacon plate cannot loosen from the base plate. The beacon plate may be produced by injection molding or extrusion.

In order to increase the rigidness of the guide beacon it is provided by the invention that the edge profiles are formed as hollow profiles for receiving reinforcement elements. More particularly, the edge profiles of the beacon plate and base plate are edge portions of the same which are formed by an extrusion method. Such edge profiles, or edge portions, are shown in the accompanying drawing figures and are described in greater detail hereinafter. Thereby it is possible to adapt the beacon plate to different requirements and load conditions. The reinforcement elements may comprise, if necessary, weak points, in order to influence the behavior of the bacon plate. The reinforcement elements can be removed without difficulty so that they can be replaced after damage.

For clamping and receiving the reinforcement elements it is provided that the edge profiles are formed as outwardly open trough profiles. Thereby the reinforcement elements are easily replaceable.

For holding the beacon plate, it is provided that the recess of the base plate is formed as a slot with eye-shaped end portions and with, at least, one transverse passage for a securing element. Thereby the beacon plate can be clamped firmly and is safely supported.

The clamping effect is increased in that the slot walls comprise a comb-like profile.

One obtains particularly simple and adaptive reinforcement elements in that the reinforcement elements are provided as tubes rods or spring elements. The spring elements may be helical springs. By an appropriate dimensioning of the reinforcement elements it is possible to change stepwise the deformability of the beacon plate.

A warning lamp can be arranged in such a manner that on the upper end of the guide beacon a receiver for a warning lamp is provided.

The warning lamp can be connected optionally to the guide beacon in that the receiver for the warning lamp is provided in an attachment of the guide beacon.

A protected electrical connection of the warning lamp is secured in that the connecting line for the warning lamp is arranged in an edge profile and that in the base plate a battery is incorporated.

The recognizability of the guide beacon can be increased in that, on the upper end of the beacon plate, reflective elements in color, shape, and size of a warning lamp are arranged. Same may be provided in addition to or instead of the reflecting foil.

An additional reinforcement of the beacon plate is possible in that the beacon plate comprises hollow cells. These hollow cells may receive reinforcement elements. Thereby the elasticity or the stiffness of the beacon plate can be adjusted within wide limits. In case of a bending or a folding down of the beacon plate, initially, the reinforcement elements maintain the deformation due to their toughness so that the beacon plate does not spring back. Thereby damages by an uncontrolled springing back are avoided. However, the beacon plate together with the reinforcement elements may be bent back in a nondestructive manner into the original shape so that the beacon plate is further usable.

The reinforcement elements include a tough, deformable material. The reinforcement elements may also be a ferrous metal or a nonferrous metal. The reinforcement elements have preferably a rod-shaped or tube-shaped configuration. The reinforcement elements may be co-extruded together with the beacon plate.

BRIEF DESCRIPTION OF THE DRAWINGS

One embodiment of the invention will be described in the following with reference to the accompanying drawings, wherein FIG. 1 is a partly broken away view of a guide beacon according to the invention, FIG. 4 shows a top view to the beacon plate on an enlarged scale, and, FIG. 5 shows a partial top view on an enlarged scale, of the view of FIG. 4, with an alternative reinforcement means for the edge portions of the beacon plate of the invention.

DETAILED DESCRIPTION OF A PREFERRED EMBODIMENT OF THE INVENTION

Figure 2:
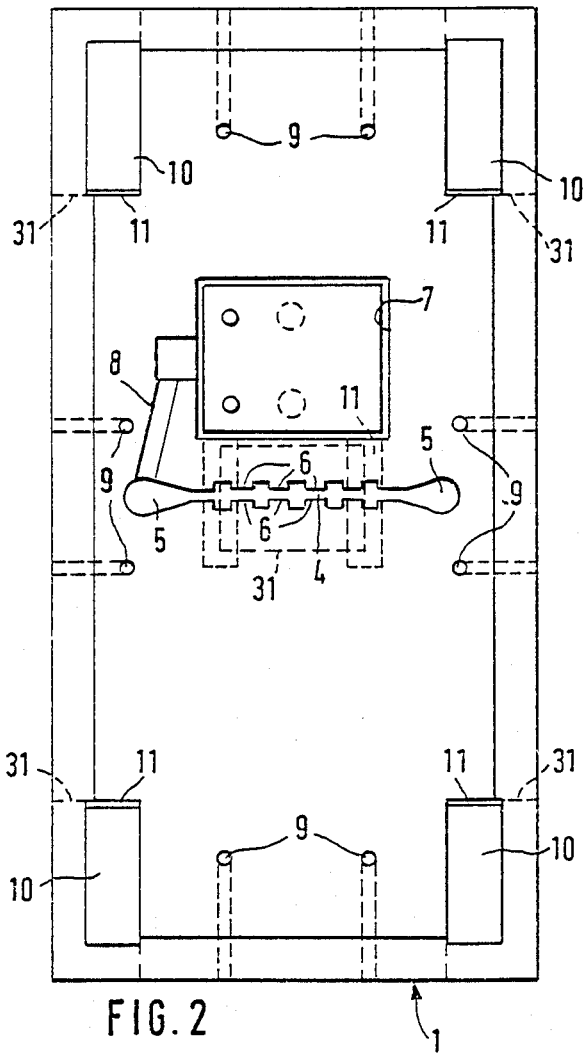
FIG. 2 is a plan view of the base plate.
Figure 3:
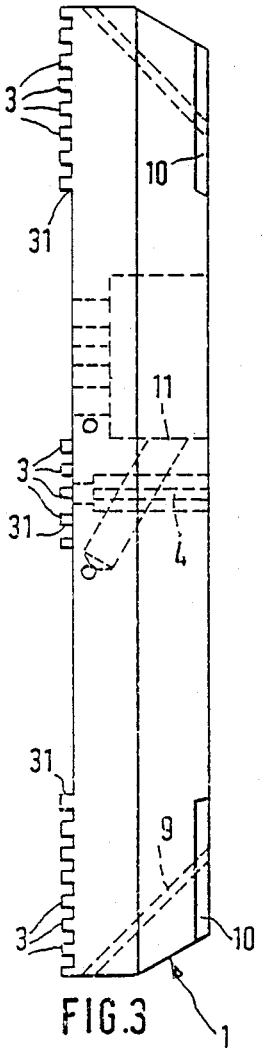
FIG. 3 is a side elevation in regard to FIG. 2, whilst

The guide beacon according to the invention comprises a base plate 1 and a beacon plate 2.

The base plate 1 is a solid structure with a mass between 20 and 40 kgs and a stability resulting therefrom. The base plate consists of a compressed material. The base plate 1 is of rectangular shape and has oblique edges provided on the upper border. On the lower side of the base plate 1, in the region of a plurality of base feet 31, nubs 3 are provided, in order to have a high steadiness. The base feet are provided in the corner regions and, if necessary, in the central portion. Approximately in the center of the base plate, a slot-like recess 4 with eye-shaped enlarged end portions 5 for the beacon plate 2 is provided. The side walls of the recess have a comblike profile each with webs 6 projecting to one another. The distance between the opposite webs is somewhat smaller than the thickness of the beacon plate so that the beacon plate is firmly clamped.

In addition, the base plate 1 has a chamber for receiving a battery, as shown in FIG. 2. From the chamber 7 a conduit 8 leads to an end portion 5.

In the side walls of the base plate passages 9 for carrying handles are provided. On the upper corners cavities 10 are provided, the walls of which, oriented in the driving direction, are equipped with a reflecting coating or with reflectors. Finally one or more clanted passages 11 are provided, which start from the chamber 7 and cross the recess 4. The passages 11 are provided for the reception of holding means or other securing elements 18 for the beacon plate 2.

The beacon plate 2 is shown in profile in FIG. 4 on an enlarged scale. The beacon plate 2 comprises a substantially plane central portion 12 and, on the longitudinal borders, in each case vertically aligned edge profiles 13, or edge portions 13, which are of eye shape and comprise a longitudinal slot 14 so that the edge profiles 13 are outwardly open and the legs spring against each other. (See, also, FIG. 5.) The edge profiles 13 serve the stiffening of the beacon plate 2 and receive reinforcement elements, comprising tubes, rods 15', as shown in FIG. 4, or hêlical springs 15'', as illustrated in FIG. 5. The tubes or rods increase the stiffness. Due to the fact that the reinforcement elements possess a certain brittleness, they break in case of strain. However, this is not detrimental, because the high impact-resistant edge profile keeps the fragments. It is possible to increase the deformability of the beacon plate by a helical spring as a reinforcement element. In addition, an electrical connection line 16 can be provided through an edge profile 13.

Within the central portion 12 hollow cells 23 may be provided in the longitudinal direction of the beacon plate. Thereby it is possible to influence the stiffness of the beacon plate. In addition, these hollow cells 23 may incorporate reinforcement elements 22. As reinforcement elements 22 rods or tubes of ferrous metal, nonferrous metal or alloys are suitable. These reinforcement elements may be coextruded together with the beacon plate. In case of a deformation of the beacon plate and of the reinforcement elements. However, it is possible to bend the reinforcement elements together with the beacon plate back into the original shape.

It should be recognized that reinforcement elements 15 are different from reinforcement elements 22. As shown in FIGS. 4 and 5, reinforcement elements 15', 15'', are for edge portions 13 of the beacon plate. By contrast, reinforcement elements 22 are placed within hollow cells 23 of central portion 22 of beacon plate 2.

The edge profiles 13 may also have another shape. It is possible to provide a T-shaped section or a Y-shaped section.

The substantially planar area or the central portion 12 of the beacon plate 2 is covered with a high-reflecting reflex foil 17, particularly adhered. The receiver for the reflex foil 17 has rejecting edge steps 21, in order to protect the reflex foil 17 mechanically.

The beacon plate 2 can be pressed into the recess 4 and is kept therein between the webs 6 in a clamping manner. The passages 11 incorporate securing elements 18 so that the beacon plate 2 is firmly connected to the base plate 1.

In addition, the invention provides a top structure 19, which can be inserted on the beacon plate 2 in the manner as is evident from FIG. 1. Connection elements, not shown, within the edge profiles 13 serve for the connection. The top structure 19 contains a receiver for the warning lamp 20. A connection line 16 for the warning lamp 20 is installed within an edge profile 13 and leads to the chamber 7, in which a battery is provided.

I claim:

1. A guide beacon for safeguarding working places, comprising:

a base plate having a recess therein, said base plate being made of a high-density material;

a beacon plate vertically arranged and secured within the recess of said base plate, said beacon plate being perpendicular to said base plate and being made of a rigid thermoplastic resin and having two vertical edge portions, said vertical edge portions each being hollow, open in an outward direction and each being capable of receiving a reinforcement element for each of said vertical edge portions for providing said beacon plate with added rigidity; and, a securing element for securing said beacon plate within said recess of said base plate wherein said recess of said base plate is formed as a slot with eye-shaped end portions and having, at least, one traverse passage for said securing element.

2. The guide beacon according to claim 1, wherein the slot of said recess of said base plate has walls having a comb-like profile.

3. The guide beacon according to claim 1, further comprising a receiver on an upper end of beacon plate, said receiver being provided as a warning lamp.

4. The guide beacon according to claim 3, wherein a connecting electrical line for said warning lamp is arranged in one of said vertical edge portions of said base plate and that within said base plate, a battery is incorporated.

5. The guide beacon according to claim 4, wherein said connecting electrical line for said warning lamp is arranged in one of said vertical edge portions.

6. The guide beacon according to claim 4, wherein said receiver for said warning lamp is provided in a top structure of said beacon plate.

7. The guide beacon according to claim 3, further comprising retroreflective elements arranged in a color, shape and size of the warning lamp, said retroreflective elements being located on an upper portion of said beacon plate.

8. The guide beacon according to claim 1, wherein said reinforcement elements for said vertical edge portions are provided as rods.

9. The guide beacon according to claim 1, wherein said reinforcement elements for said vertical edge portions are provided as spring elements.

10. The guide beacon according to claim 1, wherein said beacon plate includes hollow cells.

* * * * *